United States Patent [19]

Naiki

[11] Patent Number: 4,593,226

[45] Date of Patent: Jun. 3, 1986

[54] COLOR CATHODE RAY TUBE HAVING ELECTRON GUN WITH REDUCED EDDY CURRENT LOSS AT SHIELD CUP

[75] Inventor: Kazuaki Naiki, Tokyo, Japan

[73] Assignee: NEC Corporation, Tokyo, Japan

[21] Appl. No.: 578,673

[22] Filed: Feb. 9, 1984

[30] Foreign Application Priority Data

Feb. 9, 1983 [JP] Japan ..... 58-20111
Feb. 9, 1983 [JP] Japan ..... 58-20112

[51] Int. Cl.[4] ..... H01J 29/51
[52] U.S. Cl. ..... 313/413; 313/412
[58] Field of Search ..... 313/412, 413, 414, 411, 313/425, 458

[56] References Cited

U.S. PATENT DOCUMENTS 2,617,061 11/1952 Gier ..... 313/458
4,196,370 4/1980 Hurhes ..... 313/412 X
4,449,069 5/1984 Assil et al. ..... 313/412

*Primary Examiner*—David K. Moore
*Assistant Examiner*—K. Wieder
*Attorney, Agent, or Firm*—Laff, Whitesel, Conte & Saret

[57] ABSTRACT

A color cathode ray tube has a three beam, in-line electric gun in one end of the tube focused on a phosphor screen on the other end of the tube. A common magnetic deflection field controls all three beams, thereby causing a coma distortion, if not corrected. The three beams pass through three aligned apertures in the bottom of a shield cup which corrects the distortion. As a result, eddy currents might form around the apertures to defeat its corrective functions. These eddy currents are eliminated by slender cuts formed in the shield cup and radiating from the two outside apertures.

10 Claims, 10 Drawing Figures

COLOR CATHODE RAY TUBE HAVING ELECTRON GUN WITH REDUCED EDDY CURRENT LOSS AT SHIELD CUP

BACKGROUND OF THE INVENTION

This invention relates to a color cathode ray tube, and particularly, to a color cathode ray tube having an in-line electron gun for radiating three co-planar beams and to a self-convergence system in which rasters formed on a phosphor screen by the three beams have an equal size, under a common deflecting magnetic field.

The three co-planar beams of an in-line electron gun are deflected horizontally and vertically by a deflection yoke disposed on a funneled part of a glass envelope, to form rasters on a phosphor screen. To work the color cathode ray tube on a self-convergence system whereby a dynamic convergence correction is not required, a coma distortion is minimized by adjusting a horizontal deflecting magnetic field of the deflection yoke to give a strong pincushion distortion and a vertical deflecting magnetic field to give a strong barrel distortion, thus forming an accordant raster on the phosphor screen. In this case, however, the raster scanned by the central beam of the three beams is generally smaller in both horizontal and vertical dimensions, than the rasters formed by each of the outside beams. A mismatching of the rasters is due to a coma distortion of the deflection yoke. In order to attain a coincidence of the rasters by removing the coma distortion, a field control element consisting of a high permeability magnetic member is disposed on the bottom of a shield cup formed in a bottomed cylinder with a non-magnetic material which is mounted on a tip of the electron gun to which a rear leakage magnetic field of the deflection yoke is exerted.

Recently, a color display tube with a high resolution characteristic has been employed for display of various data, thereby giving alphanumeric character, symbol, Chinese characters, diagram, etc. in high density.

For a high density display, it is necessary for a resolution of the color cathode ray tube to be high; a focusing characteristic to be uniform; and a frequency band of a video signal circuit to be wide to improve a horizontal resolution of the displayed picture. Many scanning lines are required to improve the a vertical resolution.

To increase the number of scanning lines as an available means for high density display, a horizontal deflecting frequency $f_h$ is enhanced to a value higher than the 15.734 KHz which is used in the current standard TV system. In this case, however, a coma distortion arises on the rasters formed by the central beam and by the beams on both sides according to a horizontal deflecting field which was not observed at the horizontal deflecting frequency $f_h = 15.734$ KHz. Thus, a problem is quite unavoidable because a grade of the picture displayed on a phosphor screen is severely deteriorated thereby.

SUMMARY OF THE INVENTION

An object of this invention is to provide a color cathode ray tube using an in-line electron gun of a self-convergence system, wherein a misconvergence does not occur on the rasters formed by beams on both outsides and a central beam, as a result of coma distortion even at an increased horizontal deflecting frequency.

This invention is characterized in that a plurality of slender cuts are formed around transmission apertures for beams. The cuts are on both outsides, cut in an in-line array in the bottom of a cylindrical shield cup consisting of a non-magnetic metallic material which is mounted on a tip on an electron beam emitted side of an in-line electron gun used in a color cathode ray tube. With this structure, field control elements disposed on apertures for both outside electron beams can be prevented from experiencing an occurrence of eddy currents due to a high-frequency horizontal deflecting frequency component. Due to coma distortion, an asymmetric misconvergence may arise on the rasters formed by the central beam and beams on both outsides can be removed despite an increase in horizontal deflecting frequency, thus working the in-line electron gun as a superior gun capable of displaying high density data.

It is further desirable to form a plurality of slender cuts in the field control elements provided around the outer beam apertures so as to match the slender cuts around the outer beam in the bottom of a bottomed cylindrical shield cup.

DESCRIPTION OF THE PRIOR ART

Figure 1:
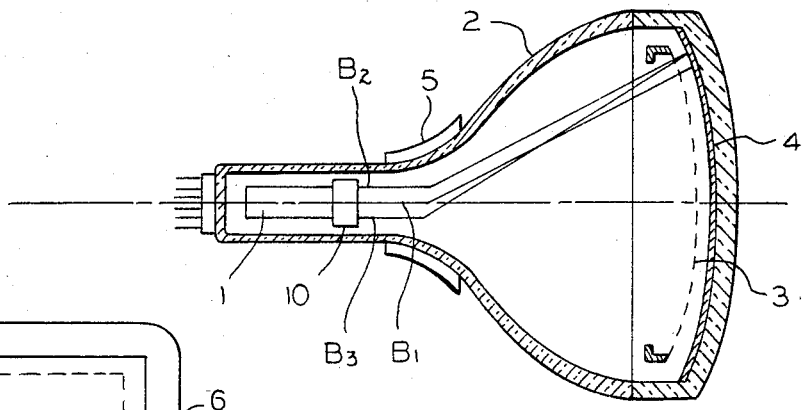
FIG.1 (Prior Art)
FIG. 1 is a longitudinal sectional view of a conventional color cathode ray tube employing an in-line electron gun of a self-convergence system.

FIG. 1 is an axial sectional view of a cathode ray tube using an in-line electron gun of a self-convergence system which requires no dynamic convergence correction means, generally used heretofore. A central beam $B_1$ and a pair of both outside beams $B_2$, $B_3$ are radiated from an in-line electron gun 1 within the same plane, and are deflected horizontally and vertically by a deflection yoke 5 disposed on a funneled part of a glass envelope 2 to form a raster on a phosphor screen 4. Screen 4 is on the end of the glass envelope 2 and is fitted inside with a plurality of phosphor picture elements which are luminous in three colors. The beams are radiated through a shadow mask 3 which is opposite screen 4.

Figure 2:
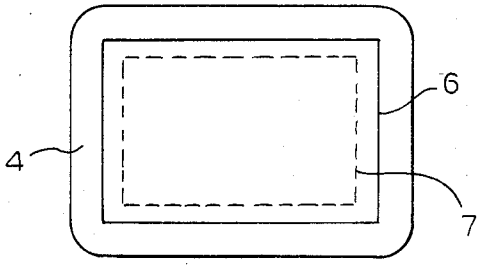
FIG.2 (Prior Art)
FIG. 2 is a front view showing rasters formed on a phosphor screen of the color cathode ray tube by a central beam and beams on both outsides.

To work the color cathode ray tube on the self-convergence system requiring no dynamic convergence correction, a horizontal deflecting field of the deflection yoke 5 is adjusted to cause a strong pincushion distortion and a vertical deflecting field is adjusted to cause a strong barrel distortion. As shown in FIG. 2, a coma distortion of a pair of beams $B_2$, $B_3$ is removed by these deflecting fields, thereby forming an almost accordant raster 6 on the phosphor screen 4. However, a raster 7 resulting from the central beam $B_1$ is still smaller than the raster caused by both the outside beams $B_2$, $B_3$, smaller both horizontally and vertically.

A mismatching of the rasters is due to a coma distortion of the deflection yoke 5. For removing the coma distortion to make the rasters coincide with each other, U.S. Pat. No. 3,772,554 disclosed a method wherein field control elements consisting of a high permeability magnetic member are disposed on a bottom 11 of a shield cup 10 formed in a bottomed cylinder. A non-magnetic material is mounted on a tip of the electron gun 1 to which a rear leakage field of the deflection yoke 5 is exerted.

Figure 3:
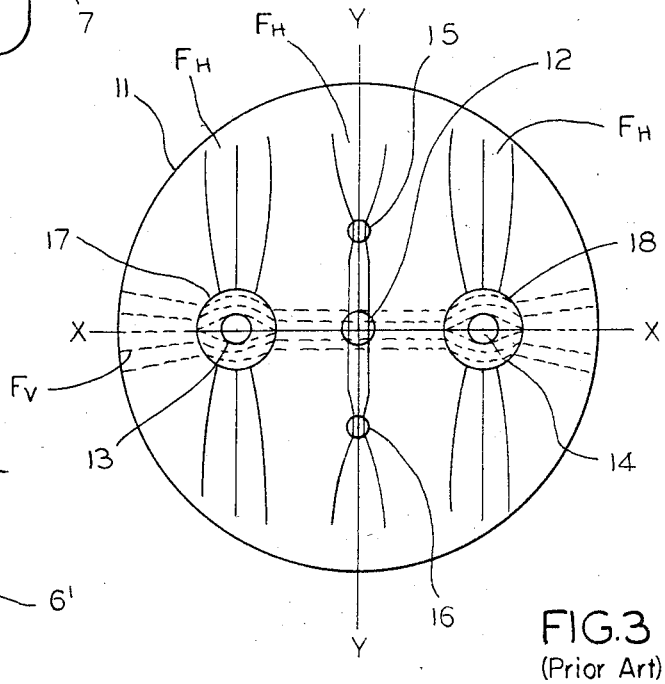
FIG.3 (Prior Art)
FIG. 3 is a plan view showing field of control elements for correcting a coma distortion of the rasters given in FIG. 2 and their effect on a horizontal and vertical deflecting fields.

FIG. 3 represents one example of the field control element, which is constituted of a pair of disc magnetic enhancers 15, 16 that are opposite each other. These enhancers are put in line with a central beam aperture 12 formed in the bottom 11 of the shield cup 10 on a vertical axis Y—Y coming in a short axis of the phosphor screen 4. Magnetic shield rings 17, 18 are disposed to surround both outside beam apertures 13, 14 formed on a horizontal axis X—X, in a long axis of the phosphor screen 4.

The magnetic enhancers 15, 16 operate for the central beam $B_1$ to increase the deflection sensitivity of a horizontal deflecting field $F_H$ of the deflection yoke 5 so that the sensitivity is greater in the center than the sensitivity of each outside beams $B_2$, $B_3$. The magnetic shield rings 17, 18 operate for both outside beams $B_2$, $B_3$ to decrease a deflection sensitivity of both horizontal and vertical deflecting fields $F_H$, $F_V$ of the deflection yoke 5 to a level which is lower than the level of the central beam $B_1$. The central beam $B_1$ has an increased deflection sensitivity of the vertical deflecting field $F_V$ which is greater than it is for both outside beams.

Accordingly, the raster 7 resulting from the central beam $B_1$ is expanded both horizontally and vertically by the field control elements 15, 16 and 17, 18. The raster 6 resulting from both outside beams $B_2$, $B_3$ is reduced thereby. Thus, the coma distortion according to the deflecting fields is removed to make the rasters 6, 7 coincide completely with each other.

Recently a color display tube with a high resolution characteristic has been employed for display of various data, thereby giving alphanumeric character, symbol, Chinese characters, diagram, etc. in high density.

High density display requires a high resolution of the color cathode ray tube, a uniform focusing characteristic, a wide frequency band of a video signal circuit which improves a horizontal resolution of the displayed picture, and many scanning lines which improve a vertical resolution thereof.

To increase the number of scanning lines for high density display, a horizontal deflecting frequency $f_h$ is enhanced to be higher than the 15.734 KHz of the currently standard TV system. In this case, however, a coma distortion arises on rasters 6', 7' caused by both outside beams and the central beam, according to a horizontal deflecting field which was not observed at the horizontal deflecting frequency $f_h = 15.734$ KHz.

Figure 4:
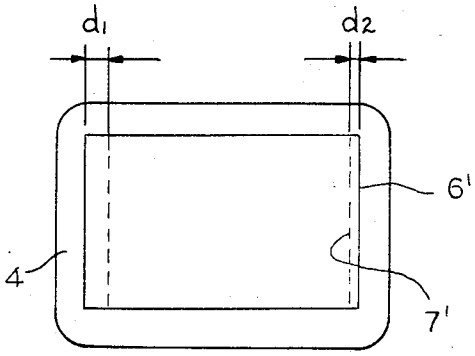
FIG.4 (Prior Art)
FIG. 4 is a front view showing a mode of coma distortion of the rasters when a horizontal deflecting frequency is increased.

As shown in FIG. 4, the raster 6' resulting from both outside beams is expanded somewhat horizontally against the raster 7', resulting from the central beam. The ratio of the expansion is then discrepant, both left and right, on the phosphor screen 4. An asymmetry arises wherein an expanded dimension $d_1$ of the left side is larger than an expanded dimension $d_2$ of the right side. The displacement of the rasters indicates a convergence error, which is capable of severely deteriorating the grade of pictures displayed on the phosphor screen. For example, in a 20-inch 90-degree deflection color cathode ray tube, the above displacements are $d_1 = 0.7$ mm and $d_2 = 0.3$ mm near the effective phosphor screen when the horizontal deflecting frequency $f_h = 15.734$ KHz is doubled as $f_h = 31.5$ KHz.

The displacement due to a coma distortion arising horizontally on the rasters 6', 7' results from both outside beams and the central beam, according to an increase in the horizontal deflecting frequency $f_h$. A description of the cause of this distortion is as follows. First of all, an eddy current is generated around both outside beam transmission apertures 13, 14 and in the magnetic shield rings 17, 18 which are disposed around the outer beam apertures 13, 14. The eddy current is caused by a horizontal deflecting field component induced in the bottom 11 of the shield cup 10 and penetrating the plan of the bottom. As a result, a magnetic flux is generated to prevent a magnetic flux change in the magnetic shield rings 17, 18, thus decreasing the effectiveness of the magnetic shield. A loss of the magnetic flux due to the eddy current can be thoroughly neglected at the conventional horizontal deflecting frequency $f_h = 15.73$, or so. However, the loss of the magnetic flux due to the eddy current cannot be neglected, as the frequency increases. As shown in FIG. 4, the raster 6' produced by each of the outside beams is expanded horizontally against the raster 7', by the central beam.

Figure 5:
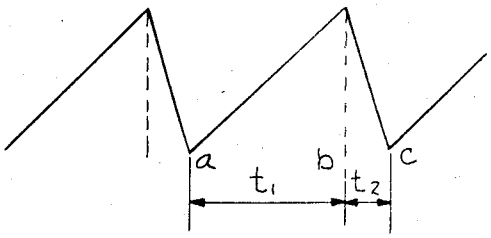
FIG.5 (Prior Art)
FIG. 5 is a waveform diagram of a current flowing in a horizontal deflecting coil.

On the other hand, a saw tooth current is used in a horizontal deflecting coil of the deflection yoke 5, for horizontal scanning as shown in FIG. 5. In this figure, a time period $t_1$ from a point a to a point b is a horizontal scanning time, and a time period $t_2$ from the point b to a point c is a horizontal blanking time. Normally, time $t_2$ is about 1/5 of $t_1$. The positions of points a or c come to correspond with each other on the right-hand end. The left end position of a raster corresponds to the termination of the horizontal blanking time $t_2$ and the right end corresponds to the termination of the horizontal scanning time $t_1$. A magnetic field is generated according to a current which is changing at a velocity of about five times of the horizontal scanning time $t_1$. This field is generated in the bottom 11 of the shield cup and the magnetic shield rings 17, 18 during the horizontal blanking time $t_2$. Accordingly, a loss of the magnetic shielding effect of the magnetic shield rings 17, 18 occurs according to an eddy current loss responsive to the higher-order harmonic component field. The loss of shielding is larger on the left side of the phosphor screen than on the right side. Therefore, FIG. 4 shows a larger horizontal expanded width $d_1$ on the left side of the raster 6', than on the right side $d_2$, giving rise to an asymmetry of the coma distortion horizontally. These expansions are caused by both outside beams. The time period $t_1$ is 51 to 53 μsec. at $f_h = 15.734$ KHz which is employed in a conventional standard color TV system (NTSC system), and the eddy current loss caused thereby can be totally neglected. Thus, the above-mentioned coma distortion and the asymmetry could not be found out, essentially. However, a difference arising between time periods $t_1$ and $t_2$ in accordance with an increase in $f_h$ and further the blanking time $t_2$ for increasing the effective scanning time $t_1$ are set to be as small as possible. Thus, an asymmetry of the eddy current loss becomes too large to neglect, giving rise to the above-mentioned phenomenon.

DETAILED DESCRIPTION OF THE PREFERRED EMBODIMENTS

Figure 6:
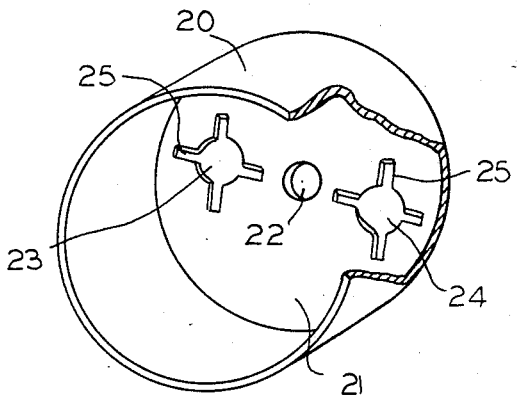
FIG. 6 is a perspective view of a shield cup given in one embodiment of this invention.
Figure 7:
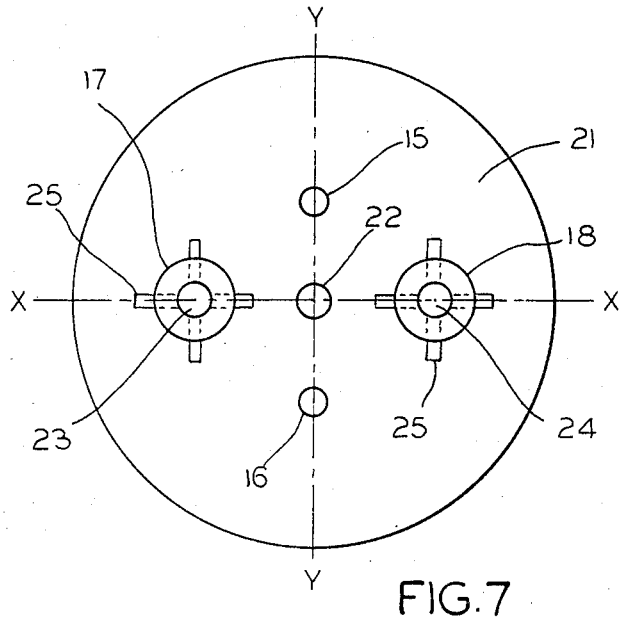
FIG. 7 is a plan view representing a state wherein field control elements are disposed on a bottom of the shield cup.

FIG. 6 is a perspective view of a shield cup 20 given in one embodiment of this invention. A central and a pair of outside beam transmission apertures 22, 23, 24 are formed in line in a bottom 21 of the shield cup 20 formed in a bottomed cylinder, with a non-magnetic material of stainless steel which is mounted on a tip of the electron gun, at regular intervals on the X—X axis, corresponding to a long axis of the phosphor screen. Slender cuts 25 are formed around both outside beam transmission apertures 23, 24 in the direction of X—X axis and also perpendicularly thereto. A field control element comprising a high permeability magnetic member similar to that of a conventional one is disposed on the bottom of the shield cup 20 as shown in FIG. 7. Namely, a pair of magnetic enhancers 15, 16 are disposed opposite each other to put in the central beam transmission aperture 22, on the vertical axis Y—Y, which is a short axis of the phosphor screen 4. The magnetic shield rings 17, 18 are disposed to surround both outside beam transmission apertures 23, 24 formed on the horizontal axis X—X. A function of these field control elements 15, 16, 17, 18 is exactly the same as the function in the above-described conventional example.

However, if the horizontal deflecting field is induced to the bottom of the shield cup 20 and if there is present a component penetrating the plane, an eddy current is prevented from arising at the apertures, by a plurality of slender cuts 25 formed around both outside beam transmission apertures 23, 24.

Accordingly, a generation of such magnetic flux is minimized to prevent a change of magnetic flux in the magnetic shield rings 17, 18 responsive to the eddy current if the horizontal deflecting frequency becomes higher than $f_h = 15.73$ KHz, the magnetic shield effect is never decreased. Consequently, if the horizontal deflecting frequency $f_h$ increases, the rasters by both outside beams will not be expanded against the raster created by the central beam. Or, the rate of expansion will not be asymmetric due to a difference between the horizontal scanning time and the horizontal blanking time.

Figure 8:
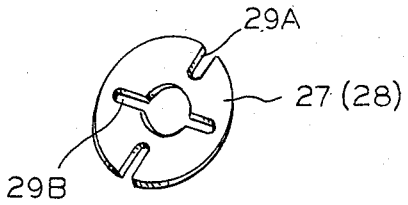
FIG. 8 is a perspective view of a magnetic shield ring used for another embodiment of this invention.

FIG. 8 is a perspective view of a magnetic shield ring 27 (28) used for another embodiment of this invention. As illustrated therein, there are formed, on the magnetic shield ring 27, two slender cuts 29A on one diameter of the two concentric circles. These cuts extend from an edge of the outside circle in the direction, toward the inside circle. Further, two slender cuts 29B are formed on a diameter which is orthogonal to the above diameter, extending from an edge of the inside circle in the direction of the outside circle. Each cut has a width, at least in the thickness dimension of the shield ring 27, which does not penetrate from the inside to the outside circle.

Figure 9:
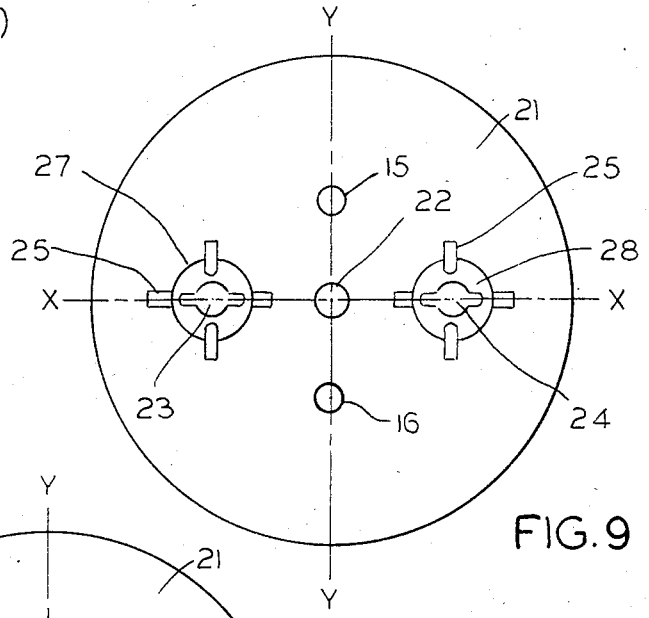
FIG. 9 is a plan view representing a state wherein a pair of field control elements are disposed on the bottom of the shield cup.

As shown in FIG. 9, the magnetic enhancers 15, 16 and the magnetic shield rings 27, 28 are disposed on a bottom of the shield cup 20 shown in FIG. 6. Namely, a pair of magnetic enhancers 15, 16 are opposite each other, to put in the central beam transmission aperture 22 on the vertical axis Y—Y. The magnetic shield rings 27, 28 are disposed to surround both outside beam transmission apertures 23, 24 provided on the horizontal axis X—X. In this case, the slender cuts 25 are formed around both outside beam transmission apertures 23, 24 of the shield cup bottom 21. The slender cuts 29A, 29B for the magnetic shield rings 27, 28 are positioned to coincide with each other and then are welded in place. The deflecting function of these field control elements 15, 16, 27, 28 is exactly the same as that described in the foregoing conventional example.

Even if the horizontal deflecting field $F_H$ is induced in the bottom 21 of the shield cup 20, and if there is present a component penetrating the plane, an eddy current is prevented from arising on the magnetic shield rings 27, 28 because a plurality of slender cuts 25, 29A, 29B are formed around both outside beam transmission apertures 23, 24 and magnetic shield rings 27, 28.

Accordingly, a generation of magnetic flux is minimized to prevent a change of magnetic flux in the magnetic shield rings 27, 28, in response to the eddy current. Even in case the horizontal deflecting frequency becomes higher than $f_h = 15.73$ KHz, which is employed in the current standard color TV system, the magnetic shield effect is never decreased regardless of the higher frequency.

The above description has referred to the case wherein field control elements comprises a combination of a pair of magnetic enhancers and magnetic shield rings. Each is used for the correction of a coma distortion of the rasters by the central and both outside beams, which ar related as shown in FIG. 2. However, the invention is not necessarily limited only thereto. It can be applied to the correction of a coma distortion having various patterns and also on field control elements having other shapes.

Figure 10:
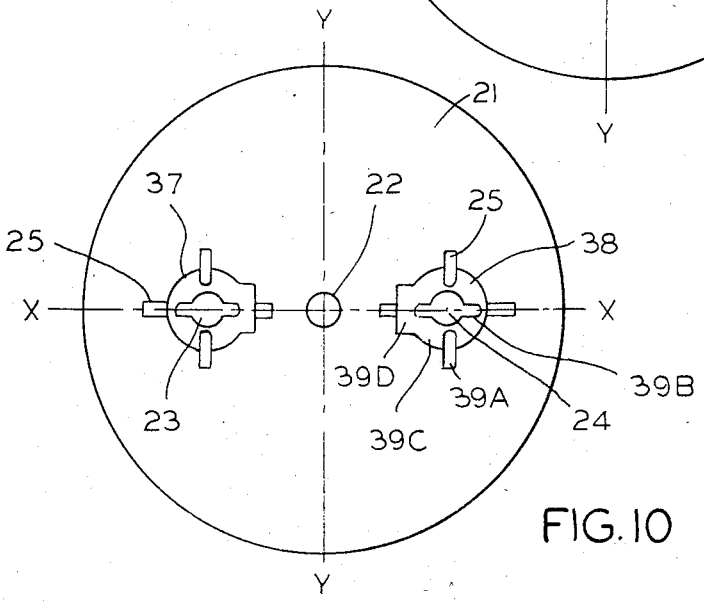
FIG. 10 is a plan view representing further embodiments of this invention.

For example, cuts 39A, 39B are formed in field control elements 37, 38 as shown in FIG. 10, after the slender cut 25 is formed on a bottom aperture of the shield cup 20. These elements are effective to correct the coma distortion shown in FIG. 2. Their function is then such that a horizontal raster produced by each of the outside beams is reduced until it comes to coincide with the horizontal raster produced by the central beam, by adjusting the size of an annular part 39C of the field control elements 37, 38. A vertical raster is expanded until it comes to coincide with the vertical raster produced by both of the outside beams, by increasing a sensitivity of the central beam to the vertical deflecting field by means of a projection 39D facing the central beam transmission aperture 22 side on the axis X—X. In this case, an eddy current is also prevented from arising by the cuts provided on the shield cup bottom and the field control elements. Thus, a dependence on the operation of the field control elements is removed against the horizontal deflecting frequency.

Furthermore, if this invention is applied to a random scanning system with the scanning speed undefined instead of a line-sequential raster scanning system with the scanning speed constant during an available period of scanning, the coma distortion will not arise in this case. The effectiveness becomes remarkable.

According to this invention, the field control element disposed on the shield cup bottom will not necessarily be optimized to exclusive use at every working horizontal deflecting frequencies. However, one and the same field control element can be used in common at all the frequencies.

As described above, according to this invention, dependence on action of the field control elements against horizontal deflecting frequency and also the difference in action due to a difference between horizontal scanning time and horizontal blanking time can be removed by forming a plurality of slender cuts around both of the outside beam transmission apertures formed on the shield cup bottom mounted on a tip of the in-line electron gun of the self-convergence system, or around both of the outside beam transmission apertures and the magnetic shield rings disposed on the shield cup. Consequently, an asymmetric misconvergence can be thoroughly removed. This misconvergence is due to a coma distortion on the rasters formed by central and both outside beams, despite an increase in the horizontal deflecting frequency. Thus, such an in-line electron gun is capable of displaying data in high density and superior in characteristics accordingly to an exceedingly high practicability.

Those who are skilled in the art will readily perceive how to modify the invention. Therefore, the appended claims are to be construed to cover all equivalent structures which fall within the true scope and spirit of the invention.

What is claimed is:

1. A color cathode ray tube comprising a glass envelope, an in-line electron gun in a neck portion of said glass envelope for radiating three electron beams, a phosphor screen formed on an end of said glass envelope, a shadow mask disposed inside said envelope and adjacent said phosphor screen, a deflection yoke for deflecting said three electron beams radiated from said in-line electron gun to form rasters on said phosphor screen, said in-line electron gun including a shield cup on the side of said deflection yoke with three apertures therein for passing said three electron beams, two of said three apertures being outside a third and centrally positioned one of said three apertures, a plurality of slender cuts being provided around both of the outside apertures to reduce eddy current loss caused by a deflection field of said deflection yoke.

2. The color cathode ray tube as defined in claim 1, wherein the cuts around said outside apertures of said shield cup extend both longitudinally and transversely.

3. A color cathode ray tube comprising a glass envelope, an in-line electron gun provided on a neck portion of said glass envelope for radiating three electron beams, a phosphor screen formed on an end of said glass envelope, a magnetic deflection yoke for deflecting said three electron beams to form rasters on said phosphor screen, said in-line electron gun including a shield cup near said deflection yoke with three apertures in line and with magnetic field control elements made of a magnetic material disposed on said shield cup around the outside two of said three aligned apertures, a plurality of slender cuts being provided around said outside two apertures and in said field control elements to reduce eddy current loss caused by a deflection field of said magnetic deflection yoke.

4. The color cathode ray tube as defined in claim 3, wherein the cuts around said outside two apertures of said shield cup and the cuts in said field control elements extend in expansion both longitudinally and transversely.

5. The color cathode ray tube as defined in claim 1, wherein the cuts around said outside apertures of said shield cup extend radially.

6. The color cathode ray tube as defined in claim 3, wherein the cuts around said outside two apertures of said shield cup and the cuts in said field control elements extend in expansion radially.

7. A color cathode ray tube comprising a three beam electron gun means at one end of said tube common magnetic deflecting field means for focusing said three beams upon a phosphor screen at the other end of said tube, whereby three rasters are formed which would have a coma distortion if uncorrected, said electron gun having a coma distortion correcting shield cup with three apertures for passing said three beams whereby eddy currents are likely to form around at least one of said apertures, and at least one slender cut formed in said cup and radiating from at least said one of said apertures to eliminate the formation of eddy currents around said one aperture.

8. The cathode ray tube of claim 7 wherein said shield cup has three in-line apertures for passing said three beams, each of the outside apertures having four of said slender cuts radiating therefrom, said four cuts being two pair of diametrically opposed cuts, a first of said pair of cuts extending along a horizontal axis of said screen and the other of said pair of cuts extending along a vertical axis of said screen.

9. The cathode ray tube of claim 8 and a magnetic shield ring for association with each of said outside apertures, said shield ring comprising a central circular aperture with a first two diametrically opposed slender cuts extending from said central circular aperture toward the periphery of said ring and a second two diametrically opposed slender cuts extending perpendicularly from the outside periphery of said ring toward the central aperture of said ring.

10. A color cathode ray tube for a high density display comprising a glass envelope, an in-line electron gun means on a neck portion of said glass envelope for radiating three electron beams, a phosphor screen formed on an end of said glass envelope, magnetic deflection yoke means for deflecting said three electron beams to form rasters on said phosphor screen with a horizontal deflection frequency which is higher than 15.734 KHz, said in-line electron gun having a shield cup facing toward said phosphor screen, said shield cup having three aligned apertures in the bottom portion thereof for passing said three electron beams, and a plurality of slender cuts positioned around the outside two of said three aligned apertures to reduce eddy current loss caused by a deflection field of said magnetic deflection yoke.

* * * * *